US005826135A

United States Patent [19]

Lee

[11] Patent Number: 5,826,135

[45] Date of Patent: Oct. 20, 1998

[54] PAPER FEEDING CONTROL METHOD OF AN IMAGE FORMING APPARATUS

[75] Inventor: Young-Seob Lee, Seoul, Rep. of Korea

[73] Assignee: SamSung Electronics Co., Ltd., Suwon, Rep. of Korea

[21] Appl. No.: 655,167

[22] Filed: May 30, 1996

[30] Foreign Application Priority Data

May 31, 1995 [KR] Rep. of Korea ..... 1995-14063

[51] Int. Cl.[6] ..... G03G 21/00

[52] U.S. Cl. ..... 399/43; 399/361

[58] Field of Search ..... 399/43, 381, 45, 399/23, 17, 361

[56] References Cited

U.S. PATENT DOCUMENTS

| | | |
|---|---|---|
| 4,804,998 | 2/1989 | Miyawaki . |
| 5,321,485 | 6/1994 | Nukaya . |
| 5,485,247 | 1/1996 | Morishita et al. . |
| 5,489,970 | 2/1996 | Nishida . |
| 5,494,356 | 2/1996 | Mikida . |

*Primary Examiner*—Shuk Lee
*Attorney, Agent, or Firm*—Robert E. Bushnell, Esq.

[57] ABSTRACT

A method for controlling paper feeding is performed in an image forming apparatus having a feeding sensor for sensing paper feeding states and for generating a sensing signal that sequentially shifts between first and second states during the paper feeding. The method contemplates the steps of picking up and feeding a sheet of paper in response to a printing command; determining whether a predetermined time period has elapsed since the sheet of paper was picked up; after the predetermined time period has elapsed, detecting when the sensing signal shifts to the first state; after the sensing signal shifts to the first state, detecting when the sensing signal shifts to the second state; after the sensing signal shifts to the second state, starting a counting operation and detecting when the sensing signal shifts back to the first state; after the sensing signal shifts back to the first state, comparing a present counting value generated from the counting operation with a reference value; when the present counting value is less than the reference value, returning to the step of detecting when the sensing signal shifts to the second state; and when the present counting value is greater than or equal to the reference value, performing a normal image forming operation.

14 Claims, 7 Drawing Sheets

PAPER FEEDING CONTROL METHOD OF AN IMAGE FORMING APPARATUS

CROSS-REFERENCE TO RELATED APPLICATIONS

This application makes reference to, incorporates the same herein, and claims all benefits accruing under 35 U.S.C. §119 arising from an application for Paper Feeding Control Method Of An Image Forming Apparatus earlier filed in the Korean Industrial Property Office on 31 May 1995 and there duly assigned Ser. No. 14063/1995.

BACKGROUND OF THE INVENTION

The present invention relates to a paper feeding control method of an image forming apparatus, and more particularly, to a paper feeding control method of an image forming apparatus having means for sensing the feeding state of paper provided from a manual paper feeding device or an automatic paper feeding device.

Generally, in an electrophotographic image forming apparatus, such as copier, facsimile, printer or the like, the mechanism for feeding paper is an important component. In particular, this component is necessary for ensuring that paper is properly transferred through a paper conveyance path that extends through the interior of the image forming apparatus. Problems with paper conveyance can result in paper jams, which are often very inconvenient for the user of the image forming apparatus. Aside from avoiding paper jams, the paper feeding mechanism of an image forming apparatus should preferably be able to transfer paper so that an image forming operation can be performed in synchronism with the passage of the paper.

One prior art reference directed towards the subject of paper feeding is U.S. Pat. No. 4,804,998 entitled Sheet Transport Control Method For Copier And Others issued to Miyawaki. In Miyawaki '998, the passage of a sheet is sensed by a first sensor, and the timing of this passage is compared with a reference timing. Based on this comparison, increments or decrements in timing are fed back to reference timings which are respectively assigned to other sensors that are located downstream from the first sensor. While this type of conventional art is useful for preventing timing deviations from becoming accumulated, I note that it requires the use of many different sensors, which increases the overall cost of the image forming apparatus. Accordingly, I believe that a more simplistic, yet highly effective, approach to controlling paper feeding in an image forming apparatus can be contemplated.

SUMMARY OF THE INVENTION

Therefore, it is an object of the present invention to provide an improved paper feeding control method for an image forming apparatus.

It is another object to provide a paper feeding control method for preventing paper feeding errors when sheets of paper are sequentially fed during an image forming operation.

It is still another object to provide a paper feeding control method that prevents paper feeding errors attributable to unstable periods of operation of a paper feeding sensor.

To achieve these and other objects, the present invention provides a method for controlling paper feeding in an image forming apparatus having feed sensing means for sensing paper feeding states and for generating a sensing signal that sequentially shifts between first and second states during the paper feeding. The method contemplates the steps of: picking up and feeding a sheet of paper in response to a printing command; determining whether a predetermined time period has elapsed since the sheet of paper was picked up; after the predetermined time period has elapsed, detecting when the sensing signal shifts to the first state; after the sensing signal shifts to the first state, detecting when the sensing signal shifts to the second state; after the sensing signal shifts to the second state, starting a counting operation and detecting when the sensing signal shifts back to the first state; after the sensing signal shifts back to the first state, comparing a present counting value generated from the counting operation with a reference value; when the present counting value is less than the reference value, returning to the step of detecting when the sensing signal shifts to the second state; and when the present counting value is greater than or equal to the reference value, performing a normal image forming operation.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, wherein.

DETAILED DESCRIPTION OF THE INVENTION

Figure 1:
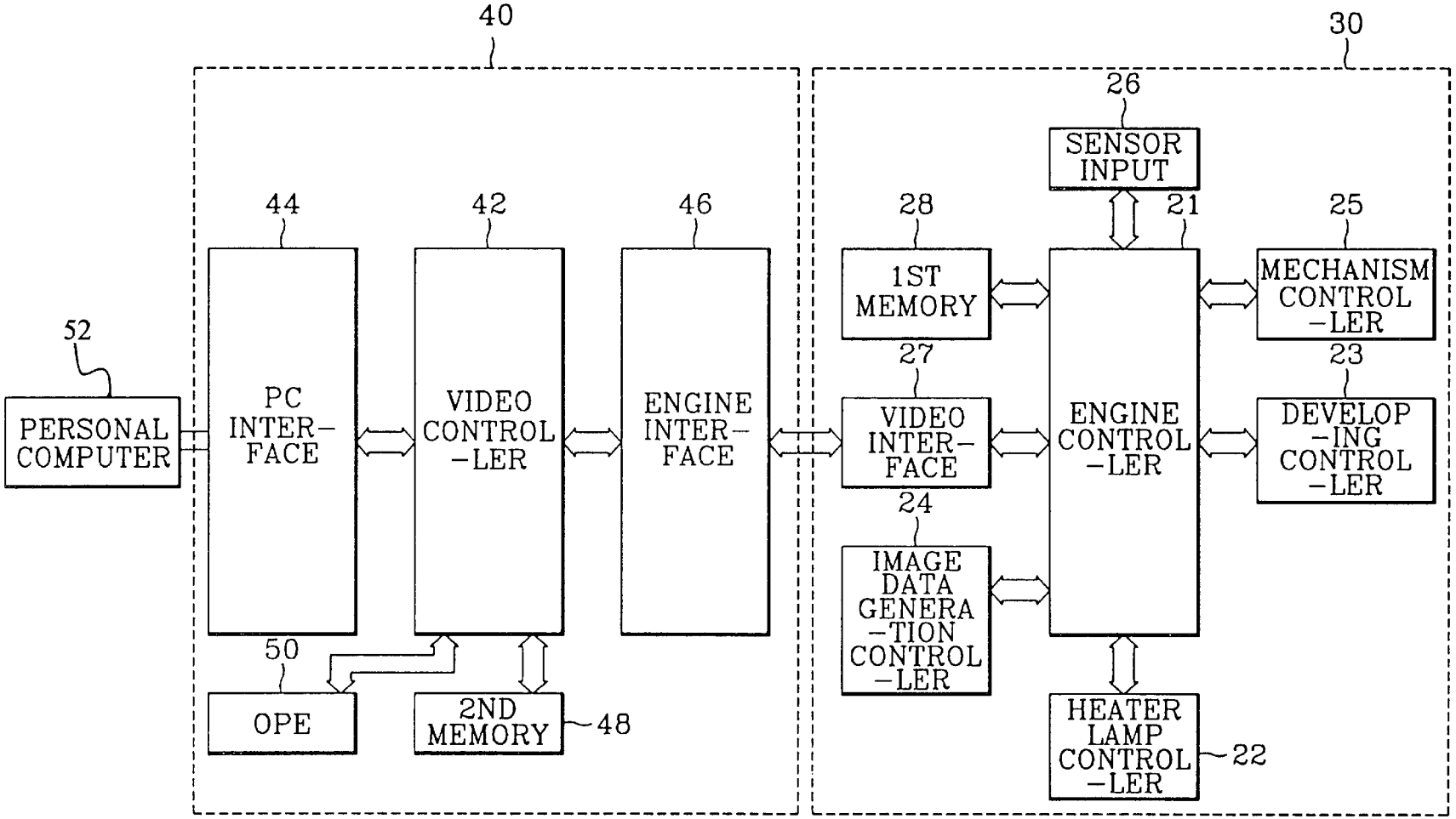
FIG. 1 is a block diagram illustrating an image forming apparatus constructed according to the principles of the present invention.

Turning now to the drawings and referring to FIG. 1, a block diagram illustrating an image forming apparatus constructed according to the principles of the present invention is shown. The image forming apparatus of FIG. 1 represents a laser beam printer which contemplates an engine unit 30 and a video control unit 40. Engine unit 30 includes an engine controller 21 for controlling the operation of an engine in the image forming apparatus. A heater lamp controller 22 controls a fixing unit under the control of engine controller 21. A developing controller 23 controls electrophotographic development under the control of engine controller 21. An image data generation controller 24 transmits image data under the control of engine controller 21. A mechanism controller 25 controls each component in the image forming apparatus under the control of engine controller 21. A sensor input 26 receives sensing signals from sensors within the image forming apparatus, and outputs the sensing signals to engine controller 21. A video interface 27 interfaces input/output (hereinafter, "I/O") signals with video control unit 40. A first memory 28 stores control programs for printing, and temporarily stores print data.

Video control unit 40 is connected to a personal computer (hereinafter, "PC") 52, and includes a PC interface 44 for interfacing I/O signals with PC 52. A video controller 42 controls video data provided from PC interface 44. An engine interface 46 interfaces I/O signals with engine unit 30. A second memory 48 stores a control program of video controller 42, and also stores data generated during execution of the control program. An operating panel (hereinafter, "OPE") 50 includes a plurality of keys for generating key data. OPE 50 provides the key data to video controller 42 and displays data from video controller 42.

Figure 2:
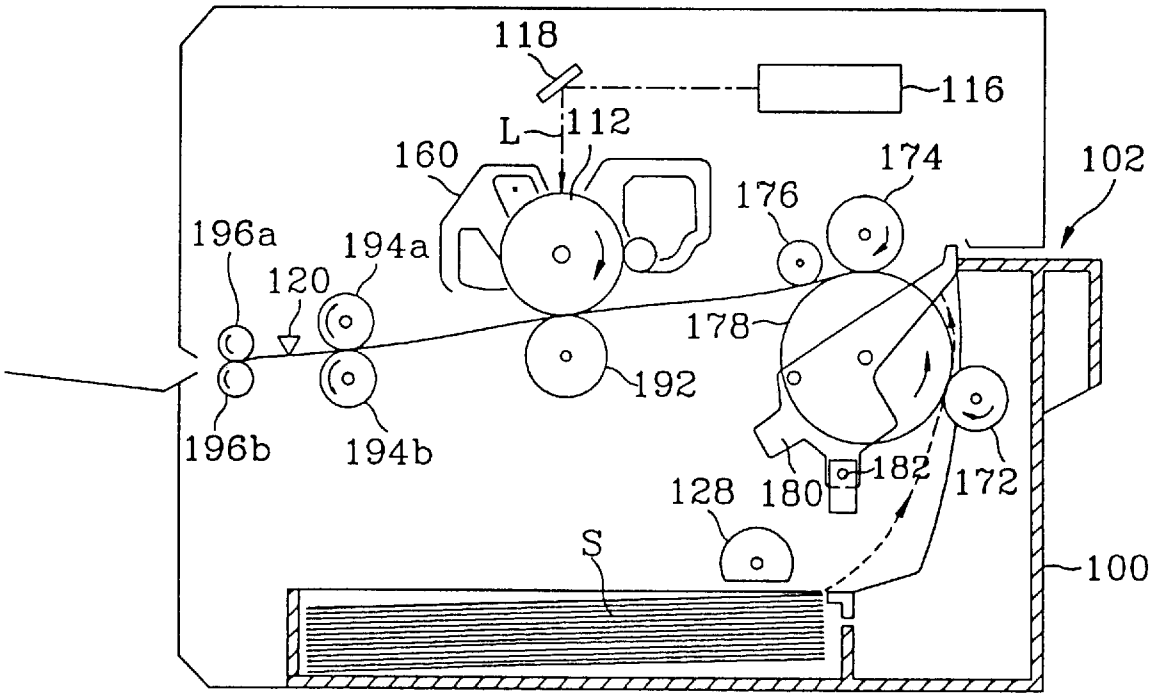
FIG. 2 is a side view illustrating the image forming apparatus of the present invention which is capable of sensing manually fed paper and performing page synchronization using a single sensor.

FIG. 2 illustrates a side view of the image forming apparatus of the present invention which is capable of sensing manually input paper and performing page synchronization with a single sensor. In FIG. 2, a pick-up roller 128 picks up individual sheets of paper S from a paper cassette 100, and expels the paper S from paper cassette 100. A feeding roller 178 and first, second and third idle rollers 172, 174 and 176 receive the paper S fed from pick-up roller 128, and transport the paper S to a transfer roller 192. An actuator 180 is rotatably driven by the paper S fed by feeding roller 178 and first idle roller 172, and is also rotatably driven by paper S that is fed from a manual paper feeding slot 102 of paper cassette 100. A feeding sensor 182 (i.e., a photosensor) senses the passage of paper S through the rotation of actuator 180, and outputs a sensing signal in dependence upon on and off states. A delivery sensor 120 (i.e., a photosensor) senses the passage of paper S from fixing rollers 194*a* and 194*b* to delivery rollers 196*a* and 196*b*. In FIG. 2, an exposing unit 116 provides output of a light beam L, which is reflected onto an outer surface of a photosensitive drum 112 via a reflector 118. This incidence of light enables formation of an electrostatic latent image upon the outer surface of photosensitive drum 112. This image is then developed with toner, and is transferred onto the surface of the paper S as the paper S passes between transfer roller 192 and photosensitive drum 112. A cleaning unit 160 is provided for cleaning the outer surface of photosensitive drum 112.

FIGS. 3A through 3F are diagrams illustrating paper feed sensing steps of actuator 180 in FIG. 2. FIGS. 4A and 4B are waveforms illustrating outputs of the sensing signal from feeding sensor 182 when paper S is normally fed, and when the feeding of paper S is delayed, respectively. The paper feed sensing steps of actuator 180 will now be briefly described with reference to FIGS. 3A to 4B.

Figure 3A:
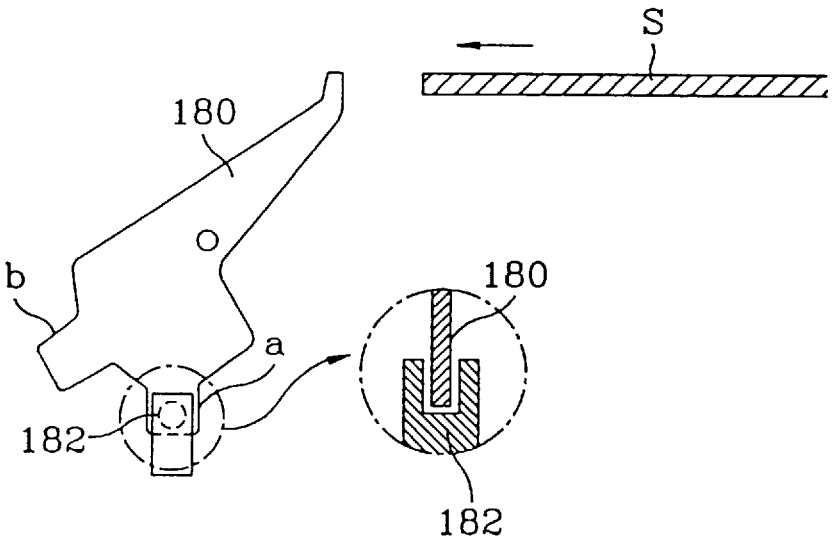
FIGS. 3A, 3B, 3C, 3D, 3E and 3F are diagrams illustrating paper feed sensing steps of an actuator in FIG. 2.
Figure 3B:
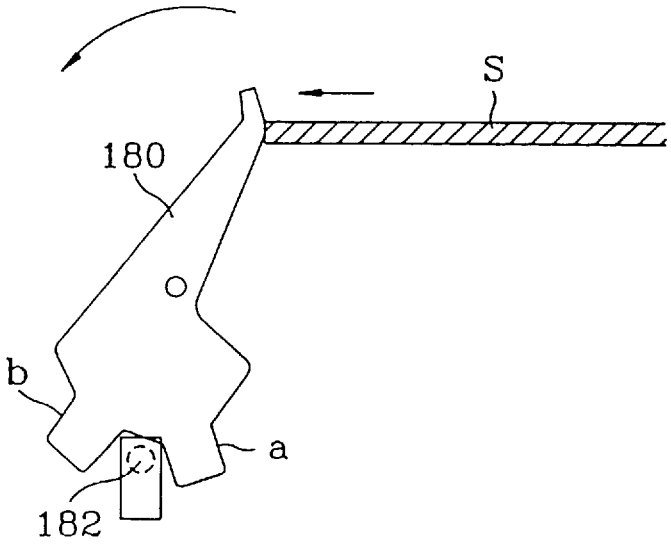
Figure 3C:
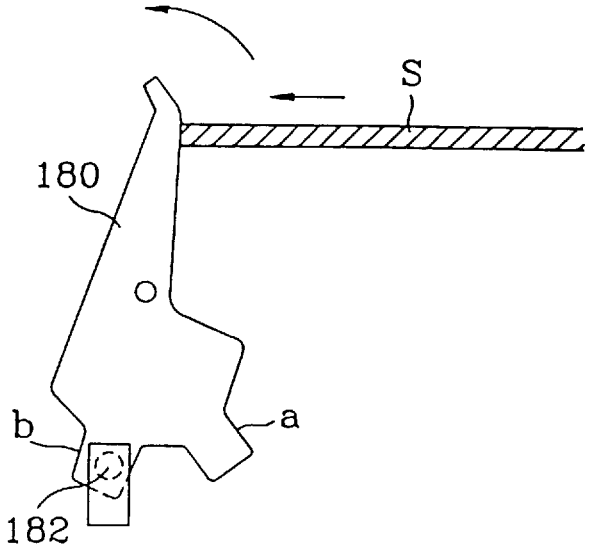
Figure 3D:
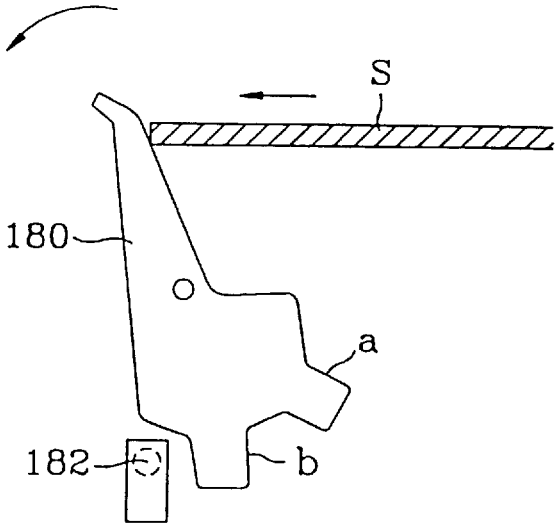
Figure 3E:
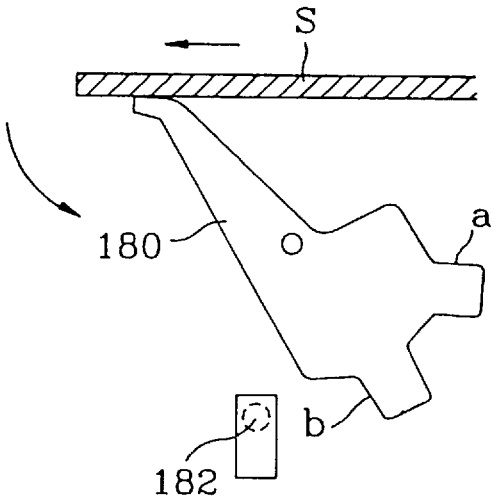
Figure 3F:
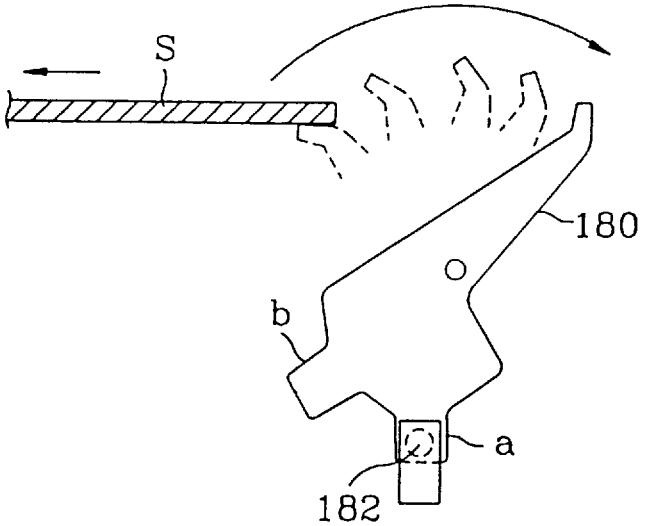
Figures 4A, 4B:
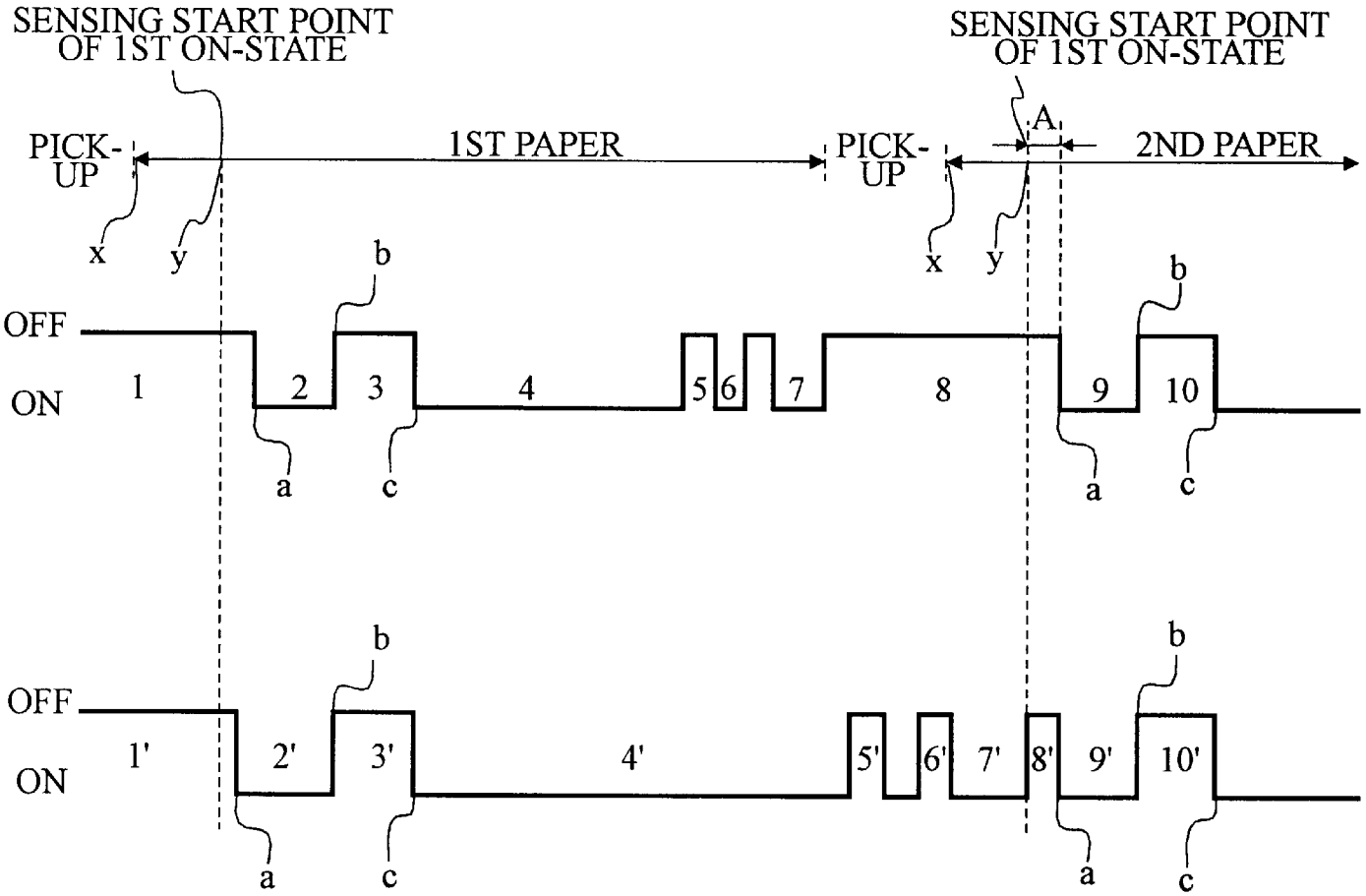
FIGS. 4A and 4B are waveforms illustrating outputs of a sensing signal from a feeding sensor in FIG. 2 when paper is normally fed, and when the feeding of paper is delayed, respectively.

As shown in FIG. 3A, in an initial state before the paper S reaches actuator 180, feeding sensor 182 maintains an off-state, as indicated by interval I in FIG. 4A, by sensing a portion "a" of actuator 180. Thereafter, as actuator 180 rotates counter-clockwise around a fixed shaft in response to the feeding of paper S, as shown in FIG. 3B, the portion "a" of actuator 180 becomes separated from a sensing region of feeding sensor 182. Accordingly, feeding sensor 182 switches to an on-state, as indicated by interval 2 in FIG. 4A, and senses that the paper S is engaging and causing rotation of actuator 180. In FIG. 3C, a portion "b" of actuator 180 is placed in the sensing region of feeding sensor 182 as the paper S continues to be fed, and feeding sensor 182 switches back to the off-state, as indicated by interval 3 in FIG. 4A. In FIG. 3D, the portion "b" of actuator 180 is separated from the sensing region of feeding sensor 182 in response to the feeding of the paper S, and feeding sensor 182 switches back to the on-state, as indicated by interval 4 in FIG. 4A. In this case, interval 4 in FIG. 4A is longer than an initial on/off period. Thus, as shown in FIG. 3E, actuator 180 is positioned just below the paper S, and feeding sensor 182 maintains an on-state. When the paper S completely passes actuator 180, as shown in FIG. 3F, actuator 180 rotates clockwise and returns to its original position, as indicated by interval 5 in FIG. 4A. As actuator 180 rotates clockwise back to its original position, feeding sensor 182 passes through a sensor chattering period, as indicated by intervals 6 and 7 in FIG. 4A. During this sensor chattering period, feeding sensor 182 alternately switches between on and off states according to a bouncing action of actuator 180, and then finally maintains the off state, as indicated by interval 8. As a next sheet of paper S is fed, feeding sensor 182 is again switched in intervals 9 and 10, which are similar to intervals 2 and 3, respectively.

In FIG. 4A, the intervals 5 and 6 are each very short in duration, as compared to the intervals 3 and 10. For example, while the intervals 3 and 10 are each typically about 350 milliseconds in duration, the intervals 5 and 6 are each about 10 to 20 milliseconds in duration. Therefore, if feeding sensor 182 shifts to an on-state, then to an off-state, and then back to an on-state within a predetermined time period after picking up a sheet of paper S, this indicates that paper S is being fed in a normal manner.

Referring now to FIG. 4B, waveforms illustrating outputs of the sensing signal from feeding sensor 182 when the feeding of paper is delayed are shown. This delay can occur, for example, when paper that is longer than the normal 8.5"×11" is used. In these cases, the switching interval between between consecutive sheets of paper becomes shorter in an effort to maintain a printing speed that is constant, irrespective of the size of paper being used. In FIG. 4B, the intervals 1' to 10' are intended to correspond respectively to the intervals 1 to 10 shown in FIG. 4A. In FIG. 4B, however, the use of longer paper causes feeding sensor 182 to remain in the on-state for an interval 4', which is longer in duration than the interval 4 shown in FIG. 4A. As a result of this extended on-state interval, the sensor chattering period is shifted into the interval during which a next sheet of paper is to be picked up for feeding. Accordingly, only a shortened interval 8' is provided for stabilizing the operating state of feeding sensor 182, thereby increasing the risk of paper feeding errors. This problem often occurs when paper feeding speed is slower than general printing speed. To alleviate this problem, the present invention monitors the on and off states of feeding sensor 182 in accordance with predetermined time periods.

Figure 5:
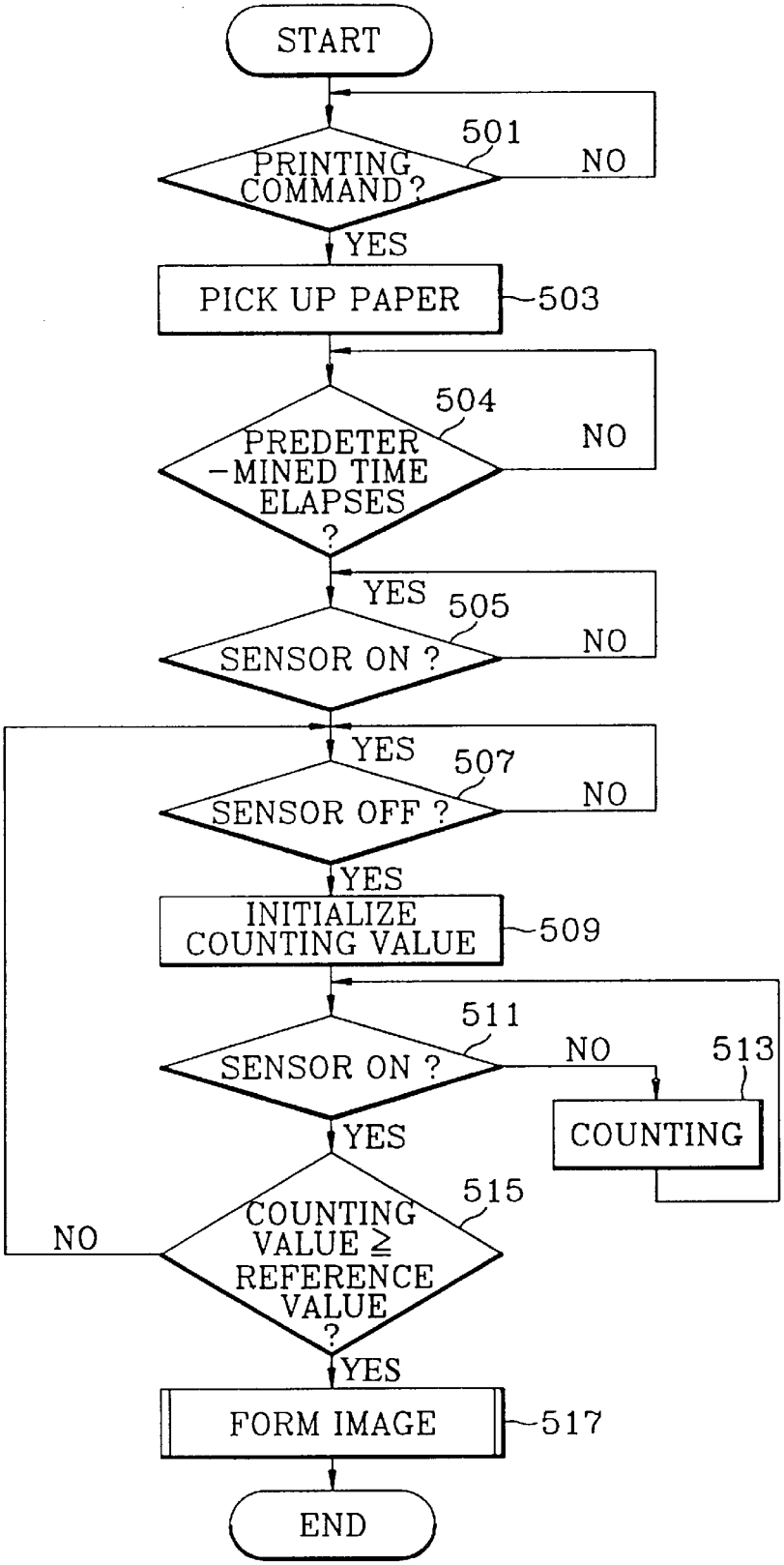
FIG. 5 is a flow chart illustrating paper feeding control steps according to a preferred embodiment of the present invention.

FIG. 5 is a flow chart illustrating paper feeding control steps according to a preferred embodiment of the present invention.

Once the image forming apparatus is turned on, engine controller 21 awaits receipt of a printing command from video controller 42, in step 501. After the printing command is received, engine controller 21 drives pick-up roller 128 to enable the pick up and expulsion of a sheet of paper S from paper cassette 100, in step 503. Referring to FIG. 4A, the paper is picked up at point x. Then, in step 504, engine controller 21 determines whether or not a predetermined time period has elapsed since the sheet of paper S was picked up for feeding. This predetermined time period corresponds to the interval from x to y in FIG. 4A. After the predetermined time period has elapsed, engine controller 21 determines whether or not feeding sensor 182 has shifted to an on-state, in step 505. As indicated in FIGS. 4A and 4B, this shift to the on-state occurs at point a. After feeding sensor 182 has shifted to the on-state in step 505, engine controller 21 determines whether or not feeding sensor 182 shifts to an off-state, in step 507. As indicated in FIGS. 4A and 4B, this shift to the off-state occurs at point b. After feeding sensor 182 has shifted to the off-state in step 507, engine controller 21 initializes a counting value, in step 509, and then determines whether or not feeding sensor 182 shifts back to the on-state, in step 511. As indicated in FIG. 4A, this shift back to the on-state occurs at point c. When it is determined in step 511 that feeding sensor 182 has not shifted back to the on-state, engine controller 21 increases the counting value, in step 513, and then returns to step 511. If, however, it is determined in step 511 that feeding sensor 182 has shifted back to the on-state, engine controller 21 determines whether or not a present counting value is greater than or equal to a predetermined reference value, in step 515. Referring to FIG. 4A, the predetermined reference value preferably represents a time interval that is longer in duration than on interval A, but slightly shorter in duration than interval 3 or 10. That is, steps 507 to 515 are performed in order to detect the interval that corresponds to interval 3, 3', 10 or 10' in FIGS. 4A or 4B. Intervals 3, 3', 10 and 10' each represent a time interval during which feeding sensor 182 normally exhibits the off-state prior to an image forming operation. The interval A has a duration similar to a chattering period of feeding sensor 182. As shown in FIG. 4A, the interval A extends from the ending point of the predetermined time period described in step 504 (i.e., point y), to a point when the sensing signal first shifts to the on-state after the paper is picked up (i.e., point a). When the counting value is greater than or equal to the predetermined reference value, this indicates that the paper is being fed in a normal manner. Accordingly, engine controller 21 performs the image forming operation, in step 517.

If, however, the counting value is less than the predetermined reference value in step 515 (i.e., engine controller 21 senses an interval having a duration that would suggest that the interval was merely a sensor chattering period), engine controller 21 returns to step 507 in an effort to detect the interval that corresponds to interval 3, 3', 10 or 10' in FIGS. 4A and 4B. After the next off-state of feeding sensor 182 is sensed in step 507, engine controller 21 initializes the counting value in step 509, and then determines whether or not feeding sensor 182 has shifted to the on-state, in step 511. When it is determined in step 511 that feeding sensor 182 is not in the on-state, engine controller 21 increases the counting value, in step 513 and then returns to step 511. When it is determined in step 511 that feeding sensor 182 is in the on-state, engine controller 21 determines whether or not a present counting value is greater than or equal to the predetermined reference value, in step 515. When the counting value is greater than or equal to the predetermined reference value, engine controller 21 performs the normal image forming operation, in step 517.

As described above, the present invention is advantageous in that when papers are sequentially fed, it is possible to prevent paper feeding errors by comparing a counting value representative of the duration of a given state of a sensing signal with a predetermined reference value, and thus eliminating paper feeding errors attributable to the sensor chattering periods between the feeding of consecutive sheets of paper.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A method for controlling paper feeding in an image forming apparatus having feed sensing means for sensing paper feeding states and for generating a sensing signal that sequentially shifts between predetermined states during the paper feeding, said method comprising the steps of:

picking up and feeding a sheet of paper in response to a printing command;

determining whether a predetermined time period has elapsed since the sheet of paper was picked up;

after said predetermined time period has elapsed, detecting a prescribed number of shifts of said sensing signal between said predetermined states;

after a final one of said prescribed number of shifts is detected, starting a counting operation and detecting when said sensing signal shifts back to a first one of said predetermined states;

after said sensing signal shifts back to said first one of said predetermined states, comparing a present counting value generated from said counting operation with a reference value;

when said present counting value is less than said reference value, detecting when said sensing signal shifts to a second one of said predetermined states; and when said present counting value is greater than or equal to said reference value, performing an image forming operation.

2. The method according to claim 1, wherein said image forming apparatus comprises a laser beam printer.

3. The method according to claim 1, wherein said prescribed number of shifts comprises two.

4. The method according to claim 1, wherein said first one of said predetermined states of said sensing signal represents an on-state of said feed sensing means, and said second one of said predetermined states of said sensing signal represents an off-state of said feed sensing means.

5. The method according to claim 4, wherein said reference value represents a reference time period that is longer in duration than a first time period and shorter in duration than a second time period, said first time period extending from an ending point of said predetermined time period to a point in time when a first one of said prescribed number of shifts is detected, said second time period defining a time interval during which said sensing signal normally exhibits said second one of said predetermined states prior to said image forming operation.

6. A method for controlling paper feeding in an image forming apparatus having feed sensing means for sensing paper feeding states and for generating a sensing signal that sequentially shifts between first and second states during the paper feeding, said method comprising the steps of:

picking up and feeding a sheet of paper in response to a printing command;

determining whether a predetermined time period has elapsed since the sheet of paper was picked up;

after said predetermined time period has elapsed, detecting when said sensing signal shifts to said first state;

after said sensing signal shifts to said first state, detecting when said sensing signal shifts to said second state;

after said sensing signal shifts to said second state, starting a counting operation and detecting when said sensing signal shifts back to said first state;

after said sensing signal shifts back to said first state, comparing a present counting value generated from said counting operation with a reference value;

when said present counting value is less than said reference value, returning to said step of detecting when said sensing signal shifts to said second state; and when said present counting value is greater than or equal to said reference value, performing an image forming operation.

7. The method according to claim 6, wherein said image forming apparatus comprises a laser beam printer.

8. The method according to claim 6, wherein said first state of said sensing signal represents an on-state of said feed sensing means, and said second state of said sensing signal represents an off-state of said feed sensing means.

9. The method according to claim 6, wherein said reference value represents a reference time period that is longer in duration than a first time period and shorter in duration than a second time period, said first time period extending from an ending point of said predetermined time period to a point in time when said sensing signal initially shifts to said first state, said second time period defining a time interval during which said sensing signal normally exhibits said second state prior to said image forming operation.

10. An image forming apparatus, comprising:

feed sensing means for sensing paper feeding states and for generating a sensing signal that sequentially shifts between first and second states during paper feeding; and engine control means for controlling an engine of said image forming apparatus by sequentially: enabling pick up and feeding of a sheet of paper in response to a printing command, determining whether a predetermined time period has elapsed since the sheet of paper was picked up, detecting when said sensing signal shifts to said first state after said predetermined time period has elapsed, detecting when said sensing signal shifts to said second state after said sensing signal shifts to said first state, starting a counting operation and detecting when said sensing signal shifts back to said first state after said sensing signal shifts to said second state, comparing a present counting value generated from said counting operation with a reference value after said sensing signal shifts back to said first state, returning to said step of detecting when said sensing signal shifts to said second state when said present counting value is less than said reference value, and enabling performance of an image forming operation when said present counting value is greater than or equal to said reference value.

11. The image forming apparatus according to claim 10, wherein said feed sensing means comprises a photosensor.

12. The image forming apparatus according to claim 10, wherein said first state of said sensing signal represents an on-state of said feed sensing means, and said second state of said sensing signal represents an off-state of said feed sensing means.

13. The image forming apparatus according to claim 12, wherein said feed sensing means comprises a photosensor.

14. The image forming apparatus according to claim 10, wherein said reference value represents a reference time period that is longer in duration than a first time period and shorter in duration than a second time period, said first time period extending from an ending point of said predetermined time period to a point in time when said sensing signal initially shifts to said first state, said second time period defining a time interval during which said sensing signal normally exhibits said second state prior to said image forming operation.

* * * * *